US005147101A

United States Patent [19]

Tiller

[11] Patent Number: 5,147,101

[45] Date of Patent: Sep. 15, 1992

[54] GOLF BALL DISPENSING AND RETRIEVING SYSTEM

[76] Inventor: Ralph Tiller, 1534 Old Creek Ct., Cardiff, Calif. 92007

[21] Appl. No.: 756,174

[22] Filed: Sep. 6, 1991

[51] Int. Cl.[5] ..... A63B 47/02

[52] U.S. Cl. ..... 294/19.2; 221/199; 221/285

[58] Field of Search ..... 294/19.1, 19.2, 99.1; 221/185, 194, 199, 281-283, 285, 288, 306, 307, 310, 303; 273/32 D, 162 R, 162 F, 201

[56] References Cited

U.S. PATENT DOCUMENTS

| | | | |
|---|---|---|---|
| 1,810,491 | 6/1931 | McClure | 294/19.2 X |
| 1,937,828 | 12/1933 | Macdonald | 294/19.2 |
| 1,958,956 | 5/1934 | Preston | 221/282 |
| 2,027,546 | 1/1936 | Macdonald | 294/19.2 |
| 2,706,657 | 4/1955 | Talley | 294/19.2 |
| 2,760,807 | 8/1956 | Watson | 294/19.2 |
| 2,801,875 | 8/1957 | McEvoy | 294/19.2 |
| 2,962,321 | 11/1960 | Fowler et al. | 294/19.2 |
| 3,127,177 | 3/1964 | Benkoe | 221/194 X |
| 3,186,593 | 6/1965 | Miotke | 294/19.2 X |
| 3,344,955 | 10/1967 | Ingham | 294/19.2 X |
| 4,058,336 | 11/1977 | Parkinson | 294/19.2 |
| 4,676,397 | 6/1987 | Hoffmeister | 294/19.2 X |
| 4,781,307 | 11/1988 | Ferro | 221/281 X |

FOREIGN PATENT DOCUMENTS

| | | | |
|---|---|---|---|
| 2416703 | 10/1979 | France | 294/19.2 |
| 2454820 | 12/1980 | France | 294/19.2 |
| 682899 | 11/1952 | United Kingdom | 294/19.2 |

*Primary Examiner*—Johnny D. Cherry
*Attorney, Agent, or Firm*—David J. Harshman

[57] ABSTRACT

A golf ball dispensing and retrieval system comprises a hollow tube for holding a plurality of golf balls. A stop mechanism is removably attachable to the bottom end of the tube for dispensing balls one at a time. The stop mechanism includes a biased lever which is pivotally attached to the outside of the tube movable between an open position and a closed position. To dispense golf balls from the tube, the lever may be moved by depressing a trigger end to an open position in which the detent is lifted away from the end of the tube to allow passage of the balls. Balls may be picked up from a surface by pressing the end of the tube and detent down onto a golf ball, which moves the detent out of the way to allow entry of a ball into the end of a tube. The lever is biased to be normally closed so that the balls remain inside the tube as desired. A stop pin is attached to the lever to prevent release of more than one ball at a time. A stand is also included to incline the tube so that as each ball is released, it rolls out of the tube for putting by the user thereof.

2 Claims, 3 Drawing Sheets

GOLF BALL DISPENSING AND RETRIEVING SYSTEM

FIELD OF THE INVENTION

This invention relates generally to systems and apparatus used as an accessory for sporting games. More specifically, the invention relates to a portable package and system for picking up and dispensing golf balls. The present invention is particularly, though not exclusively, useful for gathering golf balls and then dispensing the balls one by one for use in practicing putting golf balls to improve one's game.

BACKGROUND OF THE INVENTION

In many sporting games, it is commonly advantageous to practice repetitiously to improve one's game. The game of golf is no exception, and there have been many apparatus which are used to assist the golfer in improving the golfer's performance. In the game of golf, an important aspect of the game is having an accurate putting stroke. It is advantageous when the golfer is practicing the putting stroke to repeatedly take many strokes hitting a ball and practicing the proper swing. Typically, the golfer practices by placing a plurality of golf balls on a putting green which are repeatedly hit with a putter into holes positioned on the putting green, or on an artificial practice putting surface.

Typically, the golfer will take a handful of golf balls, such as six or seven, and place them all down on a putting surface. The golfer then putts them as a set attempting to sink them into each hole. At each hole, the golfer typically drops the balls onto the putting surface, and arranges them on the putting surface using the club head of the putter. The golfer then putts the balls one at a time toward the hole. Eventually, all of the balls of the set have been hit toward and hopefully into the hole. The balls may then be removed from the hole. Many putting greens include a retrieving cup connected to the end of a metal flag placed in the hole which can be used by the golfer to lift the balls out of the hole and place them again on the putting surface. Typically, the retrieving cup pulls the balls out of the hole and the balls spill from the cup onto the putting surface. It is usually difficult to use the retrieving cup to effectively pick the balls up off the ground. Thus, the golfer must arrange the golf balls on the putting surface either by gathering them together using the putter club head as a guide to move the golf balls into the desired position, or the golfer must bend over and reach down to place the golf balls as desired by hand. In addition, if it is desired to start putting a set of balls from a different location, usually the golfer must bend over and individually pick up all of the balls and carry them to the new starting point for the next round of practice strokes using that set of golf balls. Also, for individual putts, the golfer must bend down to pick up the ball.

Thus, the present invention recognizes it would be convenient to have a system and apparatus for picking up a plurality of golf balls from a putting surface without the need for bending over and reaching clear to the ground. It would further be advantageous to have such a device which is convenient to use and which holds and carries a plurality of golf balls. Moreover, the present invention recognizes that it would be desirable to be able to place golf balls onto the putting surface at a location that would be desired as a starting point for practicing putting a set of golf balls. The present invention further recognizes that any such apparatus which would assist in organizing, gathering up and dispensing golf balls be easily carried in standard golf equipment containers, such as conventional golf bags. It is further desirable that such an apparatus be portable.

In light of the above, the present invention satisfies the need for a portable device for picking up, carrying, and dispensing golf balls by incorporating the components of the device within a convenient all-in-one container. This is accomplished by providing a container for containing the components, and possibly additional items, which can be easily assembled for use, as desired, at home, on the practice putting green, or at any desirable location, and which can be easily disassembled and placed back into the container.

Accordingly, it is an object of the present invention to provide a portable golf dispensing and retrieving system which can be used to pick up and dispense golf balls. It is yet another object of the present invention to provide a portable ball dispensing system which allows the golfer to pick up a plurality of golf balls from a putting surface without requiring a golfer to bend over and reach down to the golf ball. It is yet another object of the present invention to provide a portable ball dispensing system which has the components packaged in an outer container which can be opened for assembling the components onto the container to use the system as needed. Still another object of the present invention is to provide a portable ball dispensing system which can hold a plurality of golf balls, each of which can be dispensed one at a time upon activation by the user thereof. Yet another object of the present invention is to provide a portable ball dispensing system which is durable and reliable in operation. Still a further object of the present invention is to provide a portable ball dispensing system which is costefficient in its manufacture and convenient to use.

SUMMARY OF THE INVENTION

A preferred embodiment of the portable ball dispensing system and packaging device comprises a hollow tube for containing the components of the device. The tube can be opened, the contents removed, and the components assembled onto the tube. The tube is preferably cylindrical, having a diameter about that of a conventional golf ball, and a length for holding up to a dozen golf balls. The bottom end of the tube is formed to allow golf balls to pass through it upon release of a resilient stop mechanism which is attached to the bottom end of the tube. The stop mechanism is movable between a closed position and an open position. In the closed position, golf balls are held in the tube and prevented from being released from the bottom end of the tube. In the open position, the balls are permitted to pass in and out of the bottom end of the tube.

The stop mechanism has a lever arm that is pivotally attached to a base which is removably attachable to the tube near the bottom end. The lever arm has a bend at its fulcrum where it is attached to the base. One end of the lever arm has a wedge-shaped detent, and the other end of the lever arm has a trigger. The attachment of the lever arm to the base is resiliently biased by a spring pin so that the lever arm is normally biased into the closed position. In the closed position, the wedge-shaped detent obstructs the lower or bottom end of the tube. By pressing on the trigger end of the lever, the detent is lifted away from the bottom end of the tube.

This opens the tube and allows a golf ball to be dispensed from the tube out of the bottom end. The lever arm includes a stop pin which passes through a hole in the tube to stop the next succeeding ball from being released, so that only one ball is released at a time. A stand is included which is attached to the top end of the tube to incline the tube and allow golf balls to roll out from the end thereof when the detent is urged by pressing the trigger to the open position. The golfer can activate the device when it is inclined on the putting surface by depressing the trigger with the putter club head to release the golf balls one at a time. The tube further includes a spacer which is attached on the outside of the tube near the bottom end. To pick up golf balls, the tube is placed over a golf ball which is on the ground and the tube is pressed downward. This movement causes the golf ball to engage the detent on one side of the ball, and an edge of the bottom end of the tube on the other side of the ball. Continued downward movement of the tube on the ball urges the detent toward the open position in which it is away from the opening of the bottom end of the tube. This allows the golf ball to enter the tube through the bottom end. Once the ball is inside the tube, the biased detent moves back to its normally closed position, which obstructs the opening in the bottom end and holds the ball within the tube. The stop mechanism is removably attachable to the tube by means of a plastic tie strap which is fastened around the outer circumference of the tube adjacent the open end, and pop rivets which fit into preselected holes in the tube.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
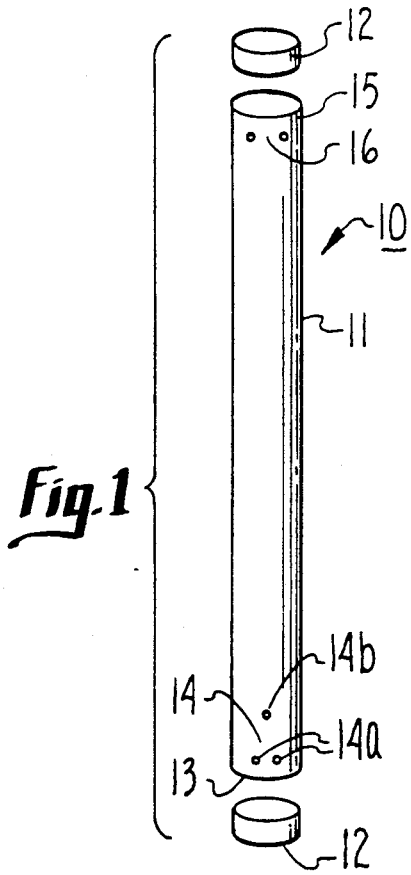
FIG. 1 is a perspective elevational view of components of the tube containing the portable golf ball dispensing system according to the present invention.

FIG. 1 shows the portable golf ball dispensing and retrieval system of the present invention generally designated 10. As shown in FIG. 1, the system 10 is totally selfcontained and comprises a tube 11 having caps 12. In the preferred embodiment, tube 11 is a hollow cylindrical tube which is long and slender to serve its intended purpose under the present invention. In particular, a tube having an inner diameter of one and three quarters ($1\frac{3}{4}$) inches, a wall thickness of sixty-one thousandths (0.061) of an inch, and a length of approximately twenty (20) inches is well suited for the present invention. Tube 11 preferably has an inner diameter and length which accommodate a dozen conventional golf balls. Appropriate materials include water-proofed cardboard, plastic, polyvinyl chloride, or other lightweight, yet sturdy strong, and reliable material which is semi-rigid.

In accordance with the present invention, tube 11 further has a bottom end 13 with a hole pattern 14, and a top end 15 with a hole pattern 16. Carried within tube 11 when caps 12 cover top end 15 and bottom end 13 are the additional components of the present invention as illustrated in the remaining figures. Moreover, additional items can be packaged in tube 11, such as a golf training device used for improving a putting stroke as disclosed in U.S. patent application Ser. No. 484,425, now U.S. Pat. No. 5,022,656 entitled "TRAINING DEVICE FOR PUTTING", which is owned by the same owner as the present invention.

Figure 2:
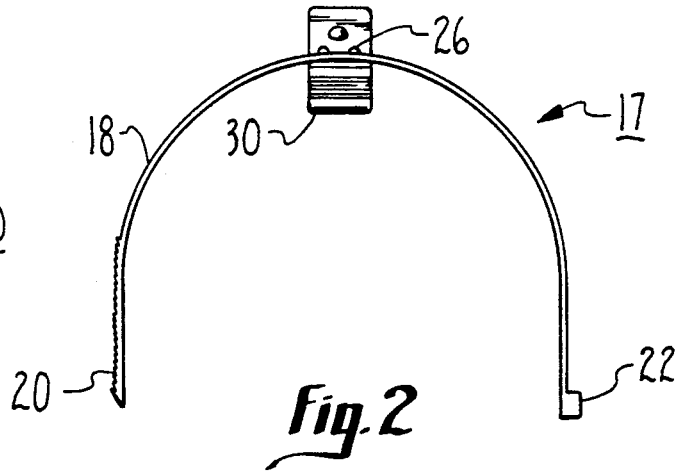
FIG. 2 is a front view of a stop mechanism for use with the portable ball dispensing system in accordance with the present invention.
Figure 3:
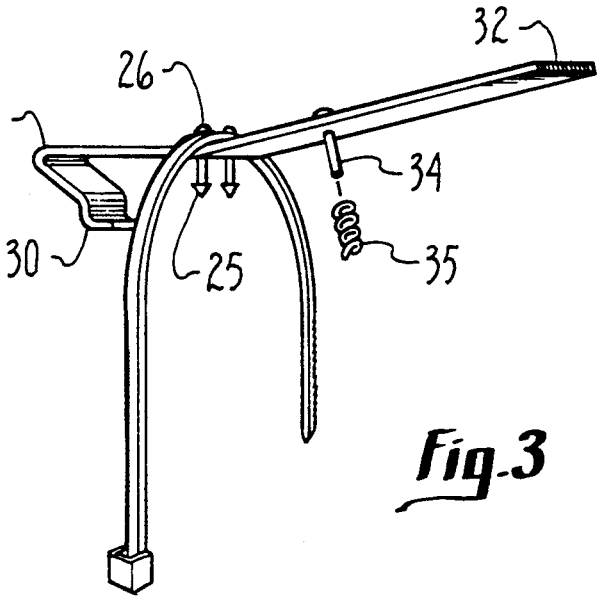
FIG. 3 is a side view of the stop mechanism shown in FIG. 2.
Figure 4:
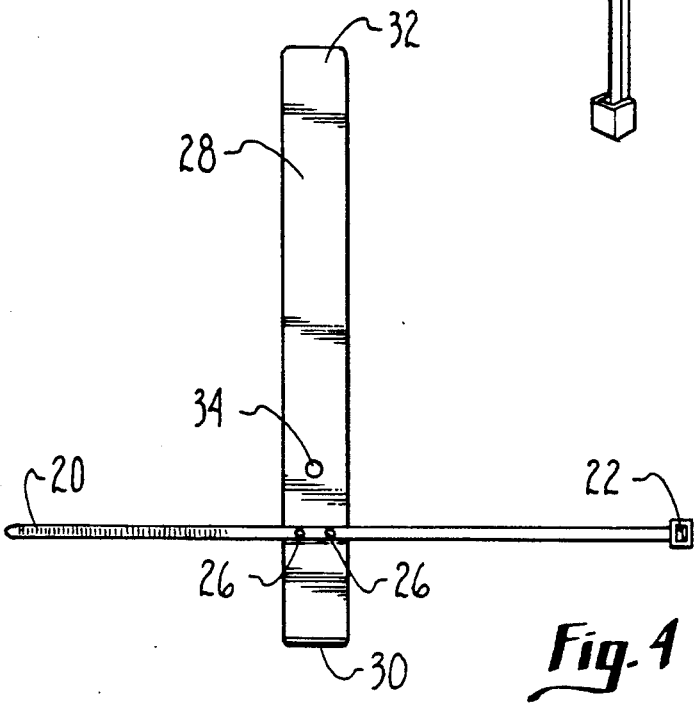
FIG. 4 is a top view of the stop mechanism shown in FIG. 2.

Referring now to FIGS. 2–4, there is shown one such component of the present system, namely a stop mechanism 17. In particular, stop mechanism 17 is removably attachable to tube 11 by means of flexible tie strap 18. Strap 18 is a sturdy, yet lightweight material, such as plastic or other tie band which can be tightly fastened about tube 11 to hold stop mechanism 17 firmly in position. In the embodiment shown, tie strap 18 is of the type which has one end 20 with a finely serrated edge which passes through an opposite locking end 22, as shown in FIG. 2. In the center of strap 18 is a base portion 24, as shown in FIG. 3, to which there is pivotally attached a lever 28. Lever 28 is attached by means of connecting pins 26 to strap 18. Lever 28 has a bend at its fulcrum where it is attached to strap 18 by pins 26. A detent 30 is formed at one end of lever 28 which is substantially wedge-shaped. At the opposite end of lever 28 is a trigger portion 32. Lever 28 further has a stop pin 34 attached thereto, which has a spring 35 which can be mounted thereon.

Stop mechanism 17 is mounted on bottom end 13 of tube 11 by aligning the head 25 of each of connecting pins 26 with holes **14*a* and pushing them through hole 14*a*. Also, spring 35 is placed on stop pin 34, which is aligned to reciprocate in and out of hole 14*b*. Strap 18 is wrapped about bottom end 13 and securely fastened to firmly hold stop mechanism 17 in place. As so positioned, lever 28 is thus biased to urge trigger end 32 away from tube 11 so that detent 30 is urged into a position which effectively obstructs the open bottom end 13. The detailed workings of detent 30 in combination with its lever action about base pivot pin 26 can perhaps best be appreciated with reference to FIGS. 5A–5C**.

Figure 5C:
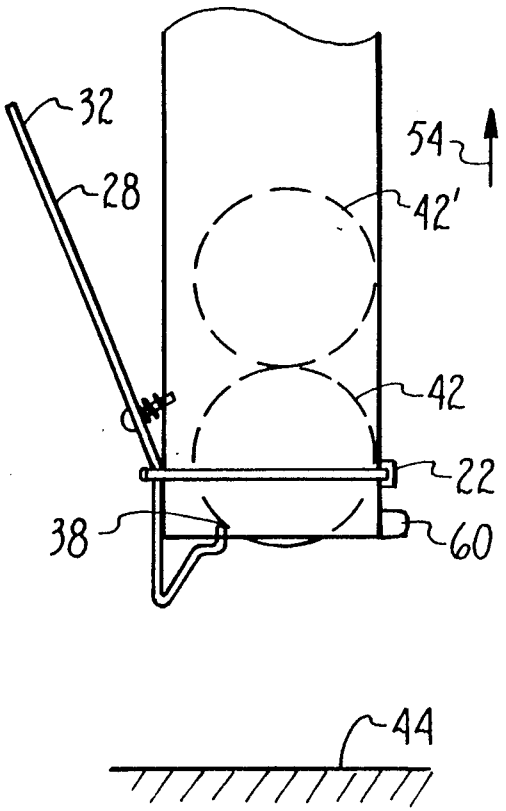
FIGS. 5A, 5B and 5C show schematic diagrams of the portable ball dispensing and retrieval system for picking up a golf ball in accordance with the present invention.
Figure 5B:
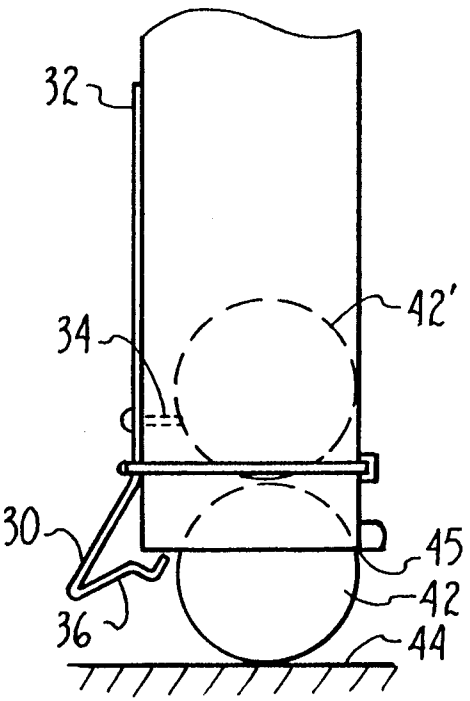
Figure 5A:
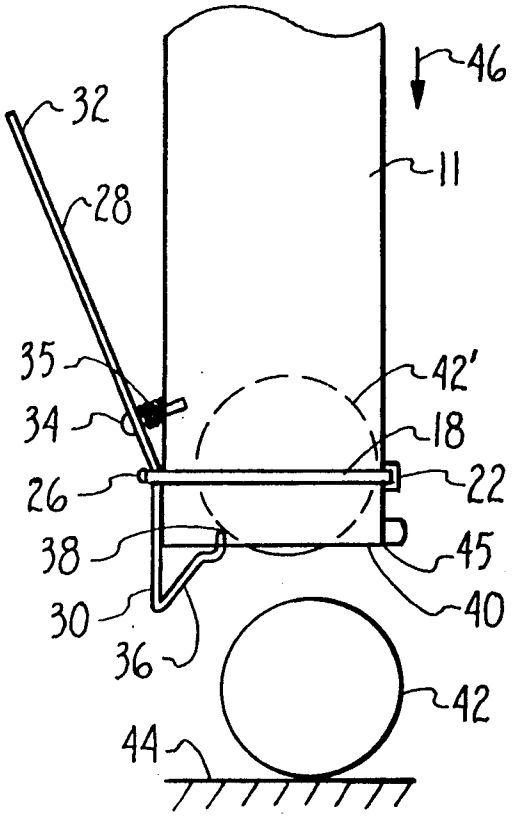

In particular, detent 30, which is bent in a wedge shape, includes a slanted front base 36 and a tip abutment 38. As seen in FIGS. 5A, 5B, and 5C, an open end 40 of tube 11 appears when cap 12 is removed from tube 11 as shown in FIG. 1, when the contents of tube 11 are removed. Tube 11, which has an inner diameter approximately the same as a golf ball 42, has stop mechanism 17 firmly attached to tube 11 as described above. By holding tube 11 essentially vertically as shown, and moving tube 11 generally in the downward direction as shown by arrow 46 toward ball 42 resting on putting surface 44, slanted front surface 36 and edge 45 of end 40 engage ball 42. Edge 45 engages the surface of ball 42 opposite the surface of ball 42 which is engaged by slanted front face 36 to prevent ball 42 from rolling away. Additional downward motion of tube 11 by the user causes slanted front face 36 to move along the outside surface of ball 42 in a cam-like action, which causes detent 30 to move away from obstructing end 40, and correspondingly causes trigger end 32 to move adjacent tube 11. It is to be noted that during this process, the projection of stop pin 34 through hole **14*b* does not interfere with allowing ball 42 to enter tube 11**.

As ball 42 enters tube 11, lever 28 is urged by spring 35 away from tube 11, and detent 30 is urged under ball 42 into position as shown in FIG. 5C. Tip abutment 38 of detent 30 holds ball 42 within end 40 of tube 11 as shown. Once ball 42 is within the end 40 of tube 11, as shown in FIG. 5C, the entire tube 11 may be lifted up as shown by arrow 54 to lift the ball 42 off of surface ground 44. Also, each ball 42 pushed a ball 42' up further into tube 11. A plurality of balls may be placed into tube 11 by thus repeating the action discussed above, which can then be carried in tube 11. Thus, each golf ball 42 causes detent 30 to move out of the way and permit passage of ball 42 into the end 40 of tube 11, and then allow detent 30 to move back to its normally closed position, in which detent 30 is biased to obstruct end 40 and hold balls 42 in tube 11.

Figure 7:
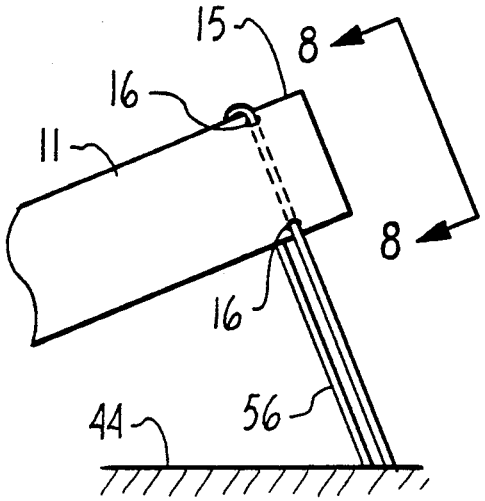
FIG. 7 is a side view of one embodiment of a stand for use according to the present invention.
Figure 8:
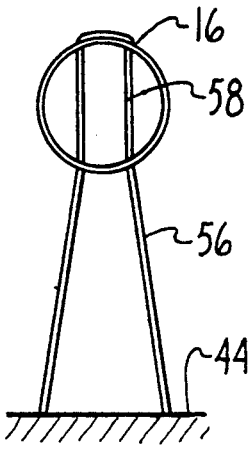
FIG. 8 is a view taken along the line 8—8 of the stand shown in FIG. 7 according to the present invention.

Once the golf balls have been picked up, the loaded apparatus 10 can then be used for dispensing balls to a user for purposes of putting. This can perhaps best be appreciated with reference to FIGS. 6A, 6B, 6C, 7 and 8. In particular, as seen in FIGS. 7 and 8, tube 11 is inclined by attaching a stand 56 which is also packed in tube 11. Stand 56 is a U-shaped wire which passes through holes 16 in top end 15 of tube 11. Stand 56 includes leg portion 58 which obstructs the lumen of tube 11 to prevent golf balls 42 from exiting the top end 15. Top end 15 of tube 11 is thus inclined with respect to ground 44 so that if the bottom end of tube 11 is unobstructed, balls 42 are caused by gravity to roll out of bottom end 13.

Figure 6A:
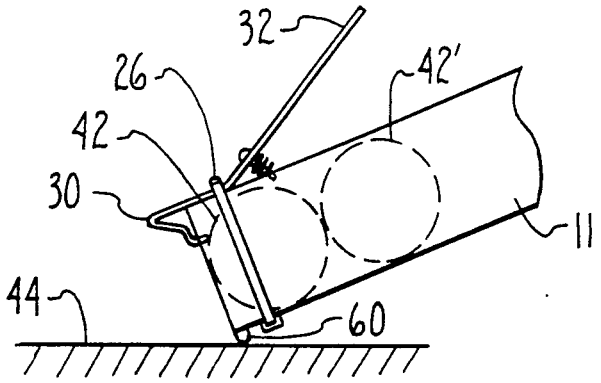
FIGS. 6A, 6B and 6C are schematic diagrams illustrating use of the portable golf ball dispensing and retrieval system for dispensing golf balls in accordance with the present invention.
Figure 6B:
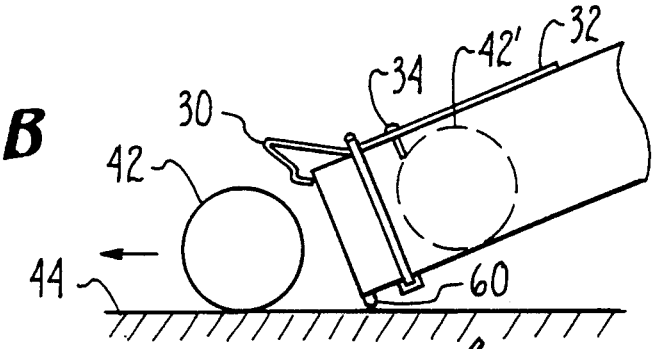
Figure 6C:
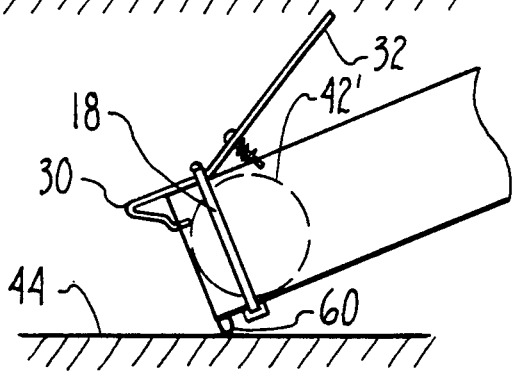

Referring to FIGS. 6A, 6B and 6C, a putter (not shown) can be used to depress trigger end 32 on tube 11 inclined on surface 44. This lifts detent 30 thereby releasing ball 42 from end 40 of tube 12. As shown in FIG. 6B, depressing trigger 32 also causes stop pin 34 to project through hole 16 into tube 11 and obstruct next ball 42' from rolling out of tube 11. Thus, only one ball is released at a time from tube 11. As also shown, tube 11 includes a spacer 60 adjacent edge 45 which elevates bottom end 13 sufficiently so that ball 42 can roll past tip abutment 38 when detent 30 is raised as shown in FIG. 6B. When trigger 32 is released, the action of spring 35 causes lever 28 to move detent 32 to its normally closed position to obstruct bottom end 13 and hold balls 42 within tube 11. When the golfer is finished putting each of the balls, and tube 11 is empty, the tube may then be used by the golfer as shown in FIGS. 5A, 5B and 5C to fill up tube 11 again with balls and repeat the practice putting strokes. When the user has completed the practice session, all of the components may be disassembled and put back into tube 11 and cap 12 may be replaced if so desired. Alternatively, apparatus 10 may be left in its assembled form and balls 42 may be kept in tube 11 as may be desired, which can conveniently be carried in a golf bag.

While the particular golf ball dispensing and retrieving system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. An apparatus for dispensing and retrieving golf balls, comprising:

a hollow tube having a bottom end formed to allow passage of golf balls therethrough;

stop means removably attachable to said tube, said stop means being movable between a closed position wherein golf balls are prevented from passing out of said end of said tube, and an open position wherein golf balls are permitted to pass through said end of said tube, wherein said stop means comprises a pivotal lever having a detent for obstructing said end, bias means associated with said lever for biasing said detent to said closed position, said lever having a trigger which can be pressed to move said detent to said open position to allow a golf ball to be released from said end of said tube, wherein said detent includes a slanted front surface engageable with a golf ball positioned partially within said end of said tube for urging said detent to said open position to allow the golf ball to enter said tube through said end, said detent moving to said normally closed position; and means for inclining said tube for allowing a golf ball to roll out from said end of said tube when said detent is urged by said trigger to said open position, wherein said stop means is removably attached to said tube by means of a strap connected around the outer circumference of said tube adjacent said end, wherein said tube includes a space-adjacent said bottom end, wherein said inclining means is removably attached to said tube by a U-shaped wire stand connected through holes in a top end of said tube.

2. An apparatus for dispensing and retrieving golf balls, said apparatus also providing packaging for all of the components of said apparatus, comprising:

a long, slender hollow cylindrical tube, having reclosable ends;

stop means being carried on said tube, and further being removably attached to the outside of said tube, said stop means being movable between an open position for admitting and releasing golf balls from said reclosable end and a closed position for preventing release of golf balls from said reclosable end; wherein said stop means comprises a pivotal lever having a detent for obstructing said end, and bias means associated with said lever for biasing said detent to said closed position, and said lever having a trigger which can be pressed for lifting said detent to said open position to allow a golf ball to be released from said tube through said end, wherein said detent includes a slanted front surface engageable with a golf ball positioned partially within said end of said tube for urging said detent to said open position to allow the golf ball to enter said tube through said end; and means for inclining said tube for allowing a golf ball to roll out from said end of said tube when said detent is urged by said trigger to said open position, wherein said stop means is removably attached to said tube by means of a strap connected around the outer circumference of said tube adjacent said end, wherein said tube includes a removable cap, wherein said tube includes a spacer adjacent said end, wherein said inclining means comprises a U-shaped wire stand attached to said tube.

* * * * *